US005529423A

United States Patent [19]

Burke et al.

[11] Patent Number: 5,529,423

[45] Date of Patent: Jun. 25, 1996

[54] CONNECTOR AND CAP ASSEMBLY FOR LOFT CONSTRUCTION

[75] Inventors: William J. Burke, Norfolk, Conn.; Daniel W. Hallock; V. Joel Thomson, both of Rifton, N.Y.

[73] Assignee: Hutterian Brethren in New York, Inc., Rifton, N.Y.

[21] Appl. No.: 308,253

[22] Filed: Sep. 19, 1994

[51] Int. Cl.[6] ..... E04B 1/343; F16B 5/06

[52] U.S. Cl. ..... 403/218; 403/169; 403/170; 52/270; 52/282.2

[58] Field of Search ..... 403/217, 218, 403/169, 170, 174, 178, 381; 52/301, 270, 282.1, 282.2, 772, 764, 761, 284; 446/476, 478; 256/65, 59; 108/180, 153

[56] References Cited

U.S. PATENT DOCUMENTS

| | | | |
|---|---|---|---|
| 2,700,560 | 1/1955 | Hansen | 285/175 |
| 3,275,351 | 9/1966 | Fentiman | 403/218 |
| 3,729,881 | 5/1973 | Disko | 52/282.1 X |
| 3,913,289 | 10/1975 | Recker | 108/180 X |
| 4,194,338 | 3/1980 | Trafton | 52/721 |
| 4,357,118 | 11/1982 | Murray | 403/172 |
| 4,361,314 | 11/1982 | Ohlson | 256/65 |
| 4,361,982 | 12/1982 | Horowitz | 47/45 |
| 4,443,127 | 4/1984 | de Leeuw | 403/218 X |
| 4,501,512 | 2/1985 | Hiltz | 108/153 X |
| 4,533,122 | 8/1985 | Bannister | 256/69 |
| 4,936,068 | 6/1990 | VictorSchönfeld et al. | 52/282.2 |
| 4,951,440 | 8/1990 | Staeger | 52/646 |
| 5,203,134 | 4/1993 | Sorenson | 52/646 |
| 5,285,613 | 2/1994 | Goldsworthy | 52/282.1 X |
| 5,401,202 | 3/1995 | Guza et al. | 446/476 |

FOREIGN PATENT DOCUMENTS

| | | | |
|---|---|---|---|
| 2241061 | 2/1974 | Germany | 52/282.2 |
| 2215988 | 10/1989 | United Kingdom | 108/180 |

*Primary Examiner*—Anthony Knight
*Attorney, Agent, or Firm*—Heslin & Rothenberg

[57] ABSTRACT

A loft connector joint employed in the construction of lofts includes a hub having a first end, a second end, an outer periphery, and an axial core oriented along a longitudinal axis extending from first end to the second end. The axial core is hollow and configured for slidable engagement with a post of a loft. A plurality of sockets are positioned about the outer periphery of the hub and facing outward from the center of the hub. Each of the sockets are configured for slidably receiving and retaining an edge of a panel of a loft. The second end of the hub has a plurality of ramps. A removable cap may be secured to the hub. The cap is bowl-shaped and has a domed top and an outer wall. A plurality of tabs extend from the underside of the cap, and the tabs are deflectable radially inward from the center of the cap. When the cap and hub are coupled together, corresponding tabs and ramps contact each other during rotation of the cap in relation to the hub. The hub/cap arrangement provides clockwise rotation at a particular torque and permits counter-clockwise rotation at torque greater than that necessary for clockwise rotation. The torque selected for clockwise rotation allows for easy attachment of the cap to the hub and post, and the torque selected for counterclockwise rotation prevents easy removal of the cap from the hub with the use of a tool, such as a screwdriver.

41 Claims, 5 Drawing Sheets

CONNECTOR AND CAP ASSEMBLY FOR LOFT CONSTRUCTION

BACKGROUND OF THE INVENTION

1. Technical Field

The present invention generally relates to loft structures. More particularly, the present invention relates to connectors and caps employed in constructing loft structures.

2. Background Information

Lofts serve an important function in early childhood development. Therefore, lofts are often utilized in classrooms as educational tools. Lofts provide a multilevel play environment, encouraging playful activity crucial to childhood development. Moreover, multi-level lofts conserve precious and limited classroom floor space.

A problem associated with classroom lofts, however, is the difficulty in their assembly and construction. When a loft arrives from a manufacturer, it must of course be erected. Often, a teacher is charged with the arduous duty of assembling and constructing the loft. More often than not, the teacher lacks the necessary skills and tools for the safe and proper assembly and construction of the loft structure. Professional installation assistance is frequently employed, significantly raising the overall cost of the loft structure.

Another problem associated with loft structures is their lack of safety. Exposed hardware connectors accompanying lofts, such as metal bolts and nuts, presents a hostile and dangerous play environment. Jagged and sharp edges associated with such hardware are often the cause of injury. Also, exposed hardware is aesthetically unpleasing to view.

A final problem associated with classroom lofts is the difficulty in modifying and relocating an existing loft structure. This problem is further attenuated with larger loft structures. Yet, early childhood development favors a fluid and dynamic play environment, where an existing loft structure can be rapidly modified and relocated. Indeed, an ideal situation would permit seasonal modifications of an existing loft structure. A large loft structure, which utilizes substantial hardware connectors, severely restricts the idea of having a dynamic loft structure. Moreover, many loft structures simply do not permit various loft configurations. Again, even if such modifications can be made, teachers generally do not have the skills, tools, and time to make the desired modifications. While it is always possible to employ professional service in modifying and relocating existing loft structures, the cost associated therewith is usually restrictive. As a result, desired loft modifications are often neglected.

Thus, a need exists for a loft connector joint which allows simple loft construction and assembly, providing a safe child play environment, which may be easily modified and relocated. Until now, such a loft connector joint has not existed.

SUMMARY OF THE INVENTION

Briefly, the present invention satisfies this need and overcomes the shortcomings of the prior art through the provision of a loft connector joint which includes a hub having a first end, a second end, an outer periphery, and an axial core oriented along a longitudinal axis extending from the first end to the second end of the hub. The axial core is hollow and configured for slidable engagement with a post of the loft. A plurality of sockets are positioned about the outer periphery and facing outward from the center of the hub, each of the plurality of sockets are configured for slidably receiving and retaining an edge of a panel of the loft. A removable cap may be secured to the hub.

The second end of the hub includes a lip extending from a ledge. On the lip, there are a plurality of ramps, each ramp having a first face and a second face. Typically, while the first face is arcuate, the second face is planar. The cap of the present invention may include a bowl-shaped member having a domed top and an outer wall. A plurality of tabs extend from the underside of the bowl-shaped member. Preferably, each tab is deflectable radially inward towards the center of the cap. The tabs may include an angled edge, which is configured to be mutually aligned with the second face of each ramp when the cap and hub are attached.

In one aspect of the present invention, the cap and hub may be mated with one another. The outer wall of the cap is joined to the lip of the hub. By mating the hub and cap, the plurality of tabs are oriented about the ledge and adjacent a corresponding plurality of ramps. When the cap is rotated clockwise in relation to the hub, each of the tabs make contact with the corresponding first faces of the ramps. Further clockwise rotation of the cap deflects the tabs radially inward. Once the tabs advance past the corresponding first faces, the cap is restrained from being rotated in a counter-clockwise direction. The configuration permits the clockwise rotation of the cap in relation to the hub at a particular torque, and only_permits counter-clockwise rotation of the cap at a torque greater than the torque needed to effect clockwise rotation.

It is therefore an object of the present invention to provide a loft connector joint that improves assembly of loft structures.

It is another object of the present invention to provide a loft connector joint for simple and easy loft assembly and construction.

It is yet another object of the present invention to provide a loft connector joint that improves the safety of loft structures.

It is another object of the present invention to provide a loft connector joint which permits numerous different configurations for a loft structure.

It is still another object of the present invention to reduce costs associated with loft construction and assembly.

It is further another object of the present invention to provide an aesthetically pleasing loft connector joint.

It is another object of the present invention to provide a loft connector joint which provides for easy and simple loft modification and relocation.

These, and other objects, features and advantages of this invention will become apparent from the following detailed description of the various aspects of the invention taken in conjunction with the accompanying drawings.

DETAILED DESCRIPTION

Figure 2:
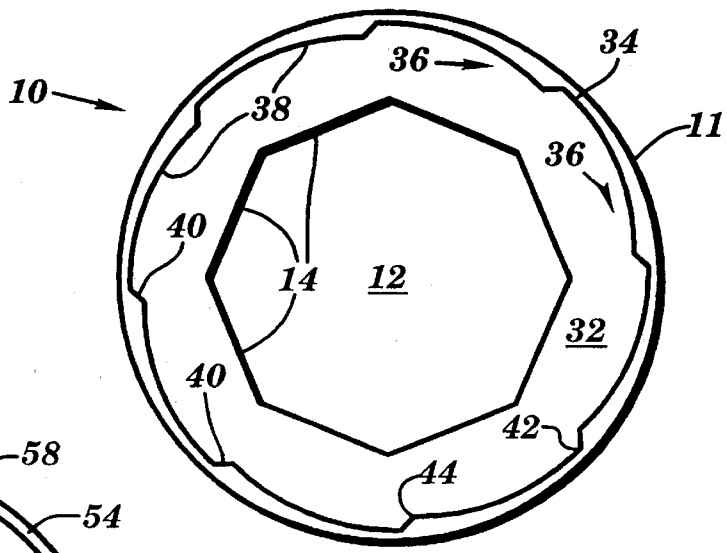
FIG. 2 is a plan view of the opposite end of the hub shown in FIG. 1 of the present invention.
Figure 1:
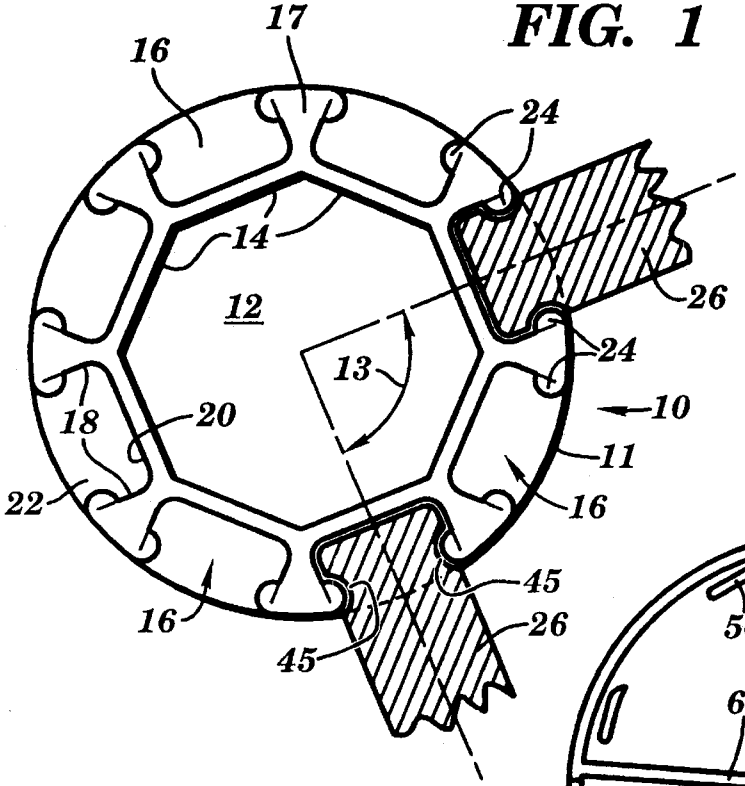
FIG. 1 is a plan view of one end a hub of a loft connector joint constructed in accordance with the present invention, showing a hollow axial core and a plurality of sockets, including the edges of two panels received by the two sockets.

In reference to the drawings, and more particularly to FIGS. 1 and 2, there is shown in accordance with the loft connector joint of the present invention, one embodiment of a hub 10. In FIG. 1, a top view of a first end 23 of hub 10 is shown, and in FIG. 2, a top view of a second end 25 of hub 10 is shown. Hub 10 has an outer periphery 11, which preferably is circular in cross-section. An axial core 12 is oriented along the longitudinal axis of hub 10. Axial-core 12 is hollow, and includes a plurality of core walls 14. Positioned about outer periphery 11, and facing outward from the center of hub 10 are a plurality of sockets 16. Each socket 16, as shown in FIG. 1, is open to first end 23 of hub 10. Second end 25 (FIG. 2) of hub 10 has a lip 34 which extends from a ledge 32. Lip 34 includes a plurality of ramps 36.

Figure 3:
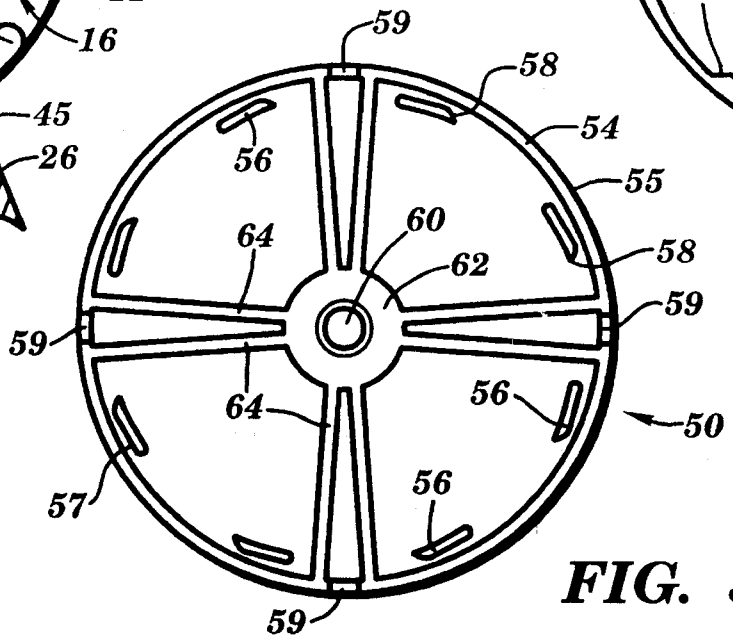
FIG. 3 is a plan view of underside of a cap of loft a connector joint constructed in accordance with the principles of the present invention.
Figure 4:
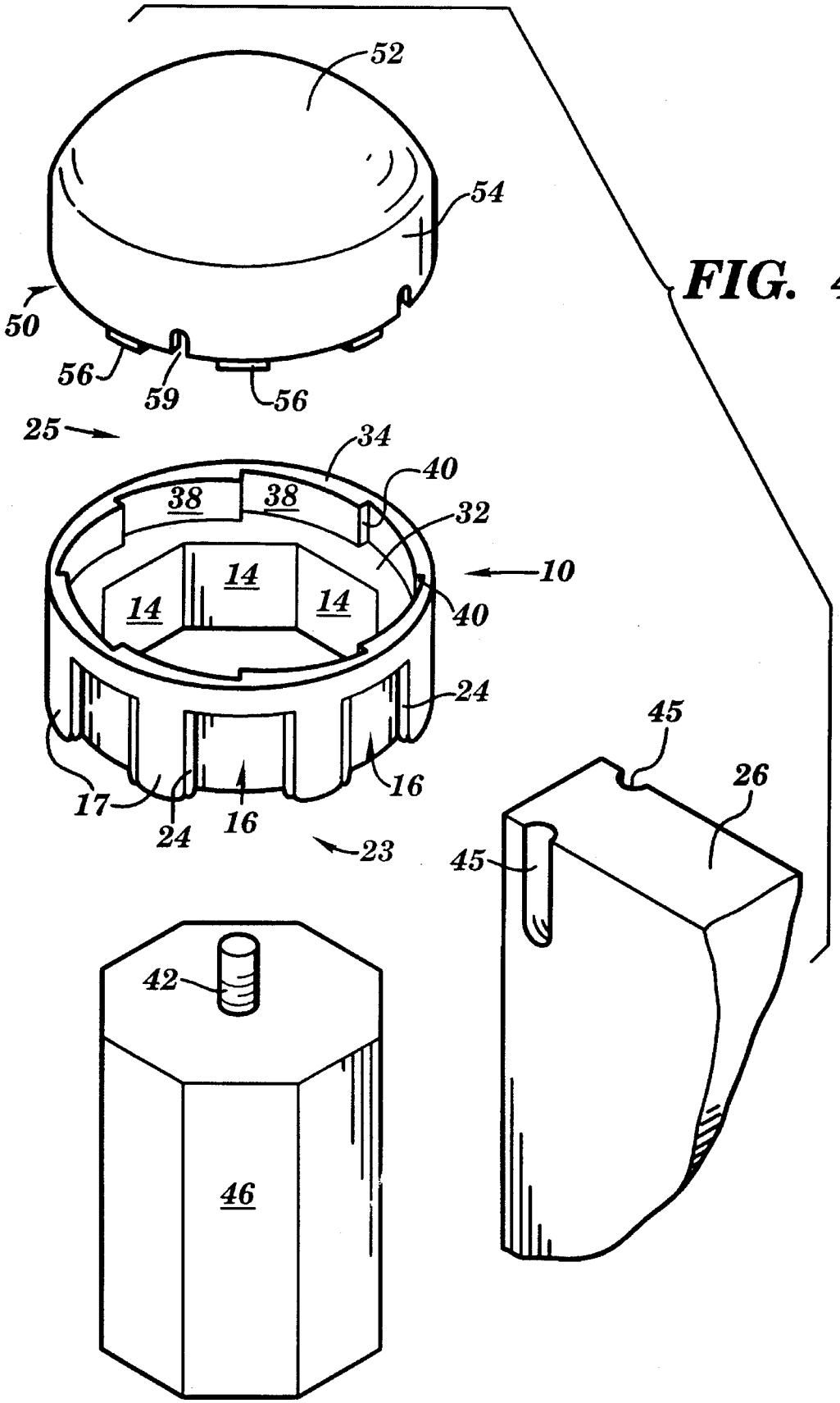
FIG. 4 is an exploded perspective view of the hub and cap of the loft connector joint of the present invention in conjunction with a panel and a post of a loft structure.

In reference to FIGS. 3 and 4, a cap 50 of the present invention is shown. Cap 50 is preferably bowl-shaped and has a domed top 52 and an outer wall 54. An outer periphery 55 defines the outer bounds of outer wall 54. A plurality of tabs 56, preferably elongated, extend from the underside of cap 50. In one aspect of the present invention, tabs 56 are deflectable radially inward towards the center of cap 50.

Referring back FIGS. 1 and 2, and in particular to hub 10, axial core 12 is shaped to correspond to the cross-sectional shape of a post 46 (FIG. 4) so that core 12 may be slidably engaged with post 46. In the preferred embodiment, axial core 12 has an octagonal-shape, with eight core walls 14 oriented substantially along the longitudinal axis of hub 10. While an octagonal-shaped axial core 12 is preferable, other axial core shapes may also be suitable for the present invention. For example, axial core 12 may have a square or rectangular shape, having four side walls oriented substantially along the longitudinal axis of hub 10. A square or rectangular shaped axial core would then permit slidable engagement with a post having a like-shaped cross section. Other cross-sectional shapes for posts may include hexagonal and triangular shapes.

A fin 17 separates each socket 16. Fin 17 is defined by two side walls 18, and outer periphery 11. As can be seen from the top view of first end 23 of hub 10, fins 17 may be triangular in shape. Each socket 16 of hub 10 is defined by two opposing side walls 18, and a back wall 20, all of which are oriented substantially along the longitudinal axis of hub 10. Each back wall 20 may correspond to a core wall 14. Back wall 20 faces radially outward from the center of hub 10 while core wall 14 faces the center of hub 10. A floor 22, positioned substantially orthogonal to side walls 18 and back wall 20, further defines each socket 16. Preferably, each side wall 20 or fin 17 includes a rib section 24 abutting therefrom. As is shown in FIG. 1, each socket 16 preferably has two opposing rib sections 24 facing one other. Floor 22, side walls 18, and back wall 20 define socket 16.

The term socket, as used throughout this specification, is meant to refer to a recess or opening employed to receive and retain the edge of a panel 26. Socket 16 enables the edge of panel 26 to be slidably received and retained by side walls 18, back wall 20, and floor 22, all of which define socket 16. In order to facilitate retention of panel 26 in socket 16, the edge of panel 26 includes two grooves 45 corresponding to the two rib sections 24 of socket 16 (FIGS. 1 & 4). Grooves 45 are sized and configured for effecting a comfortable fit in sockets 16 for engagement therein and for being easily removably therefrom. Floor 22 supports the edge of panel 26 while it sits in socket 16. In the preferred embodiment, eight sockets 16 are positioned about outer periphery 11 of hub 10, and a maximum of eight corresponding edges of panels 26 may be received therein.

In nearly all instances, fewer than all eight sockets as described the preferred embodiment will be received by corresponding panel edges. Typically, two, three, and four sockets will be engaged in a single loft construction. Each socket 16 is arranged on hub 10 so that panels may be received therein for achieving a desired angle between two adjacently engaged panels. For instance, as is shown in FIG. 1, two panel edges are engaged in sockets of hub 10, thereby creating a 90° angle 13 for the two outwardly extending panels. Various different configurations may be selected, depending on the specific loft construction at hand. Other angles which may be achieved are 45°, 135° and 180°. While the preferred embodiment is designed with adjacent sockets positioned for 45° intervals, other hubs may be designed for any angle desired.

Referring now to second end 25 of hub 10, as depicted in FIG. 2, lip 34 extends from ledge 32 at preferably a 90° angle. In the preferred embodiment, the inner border of ledge 32 conforms to the octagonal shape, i.e., eight core walls 14, of axial core 12. Lip 34, extending vertically from ledge 32, includes a plurality of ramps 36. Each ramp 36 has a first face 38 and a second face 40. Preferably, first face 38 is arcuate. The thickness of each ramp 36 increases from a minimum at 42 to a maximum at 44, thereby forming arcuate first face 38. As to second face 40, which is preferably planar, the thickness of ramp 36 increases from a minimum at a third point, 42, to a maximum at a fourth point, 44, which in the embodiment shown in FIG. 2, are the same as the first point 42 and second point 44 of first face 38, respectively. As can be seen in FIG. 2, it is preferable that the relative length of first face 38 be greater than the length of second face 40.

In the preferred embodiment, there are a total of eight ramps 36 on hub 10. While eight ramps is preferred, it is equally satisfactory to employ a different number of ramps. The number of ramps determine the torque required to engage or remove the cap.

Referring back to FIG. 3, and particularly to cap 50, each tab 56 is preferably elongated, extending substantially along the longitudinal axis of cap 50. Each tab 56 is located about the inner peripheral surface of outer wall 54. A void 57 separates the inner surface of outer wall 54 and each tab 56 so that each tab 56 is distinctly defined on cap 50. The size of void 57 is determined by moldability requirements. Each tab 56 may have a variable thickness increasing from one end to a maximum at angled edge 58. When hub 10 and cap 50 are aligned with one another, angled edge 58 is configured to make contact and align with second face 40 of ramp 36 when cap 50 is coaxially aligned and mounted on the second end 25 of hub 10. Preferably, both lip 34 and outer wall 54 are correspondingly circular in cross section. However, other corresponding shapes are equally satisfactory. For instance, the outer periphery of both hub 10 and cap 50 may be rectangular in cross section.

The underside of cap 50 may include a threaded insert 60. Threaded insert 60 is encapsulated in a core member 62. Preferably, core member 62 is cylindrical and positioned in the center of the underside of cap 50. For increasing structural rigidity and stiffness of cap 50, a plurality of support arms 64 may be attached to the underside of cap 50, extending radially outward from cylindrical core member 62 to the interior of outer wall 54. In the preferred embodiment, four sets of two support arms 64 are employed in cap 50, thereby dividing the underside of the cap into four quadrants. An opening may be positioned along outer wall 54 for insertion of a tool (not shown) such as a screwdriver therein. Preferably, four openings 59 are located between each of the four sets of support arms 64, wherein each of the four sets of support arms 64 provide a contact surface for the tool inserted into opening 59. In one aspect of the present invention, it is desirable to have two tabs 56 positioned within each of the quadrants.

In one aspect of the present invention, cap 50 may be aligned with and secured to hub 10. In the preferred embodiment, cap 50 is axially aligned with the second end of hub 10 so that outer wall 54 rests on lip 34. Outer wall 54 is preferably configured to be aligned and mated with lip 34 of hub 10 to couple hub 10 and cap 34 together. Preferably, the outer periphery 11 of hub 10 matches the outer periphery 55 of cap 50. By mating lip 34 and outer wall 54, tabs 56 are oriented about ledge 32 and adjacent to ramps 36. When cap 50 is rotated clockwise in relation to hub 10, the tabs begin making contact with the first faces of ramps 36. As cap 50 continues to rotate clockwise in relation to hub 10, tabs 58 are deflected radially inward. After tabs 58 advance past first faces 38, cap 50 is restrained from being rotated in a counter clockwise direction. The angled edges 58 of cap 50, when mated with corresponding second faces 40 of hub 10, restrains cap 50 from such counter clockwise rotation. It should be understood that first face 38 has a radius of curvature which has been selected because of a number of factors, including the stiffness of tabs 56 and the torque required for rotating cap 50 in relation to hub 10. Thus, a different radius of curvature of first face 38 may be selected for achieving a different required torque for rotation of cap 50 in relation to hub 10.

The cap/hub arrangement described hereinabove provides a means for clockwise rotation of cap 50 in relation to hub 10 at a particular torque, and provides a means for counter-clockwise rotation at a torque greater than that needed to effect clockwise rotation. In its operative state, this cap/hub arrangement acts as a safety feature, preventing children from removing the caps from loft structure 70. When attaching cap 50 to hub 10, threaded bolt 42 of post 46 is threadably inserted to threaded insert 60. The loft connector joint of the present invention permits relatively easy clockwise rotation during installation and assembly of a loft structure, but restrains counterclockwise rotation once the loft structure is erected. The removal of cap 50 from hub 10 simply involves inserting a tool, such as a screwdriver into opening 59, and exerting a torque sufficient to rotate cap 50 in the counter-clockwise direction. Each of the support arms 64 provide a contact surface for the tool so that the cap may be removed.

Figure 5:
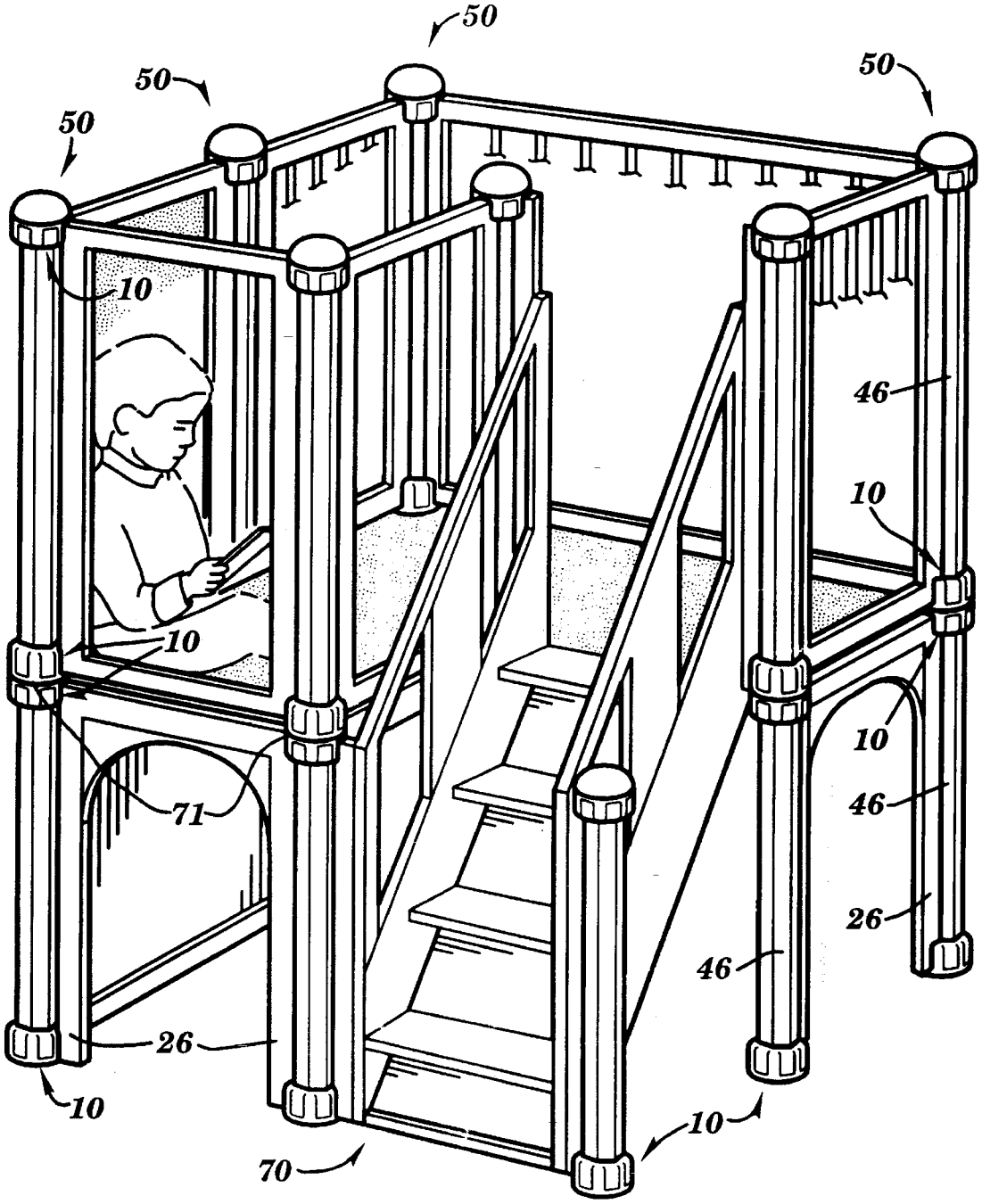
FIG. 5 is a perspective view of a plurality of the loft connector joints of the present invention as employed in a children's loft.
Figure 6:
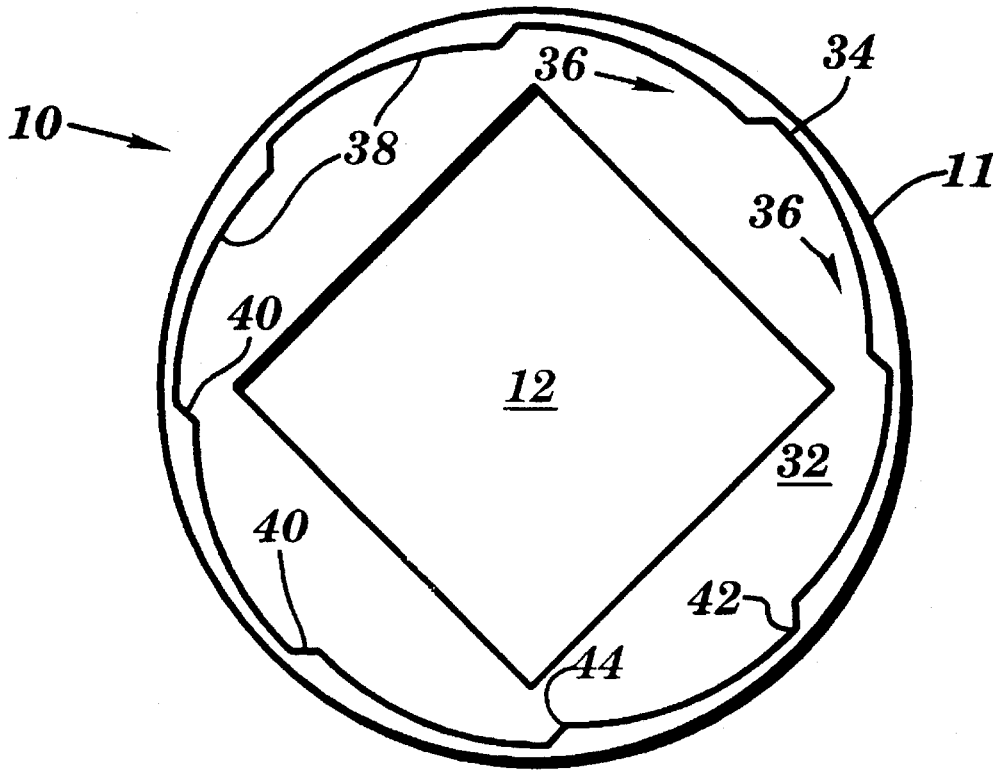
FIG. 6 is a plan view of the underside of a loft connector joint of the present invention.
Figure 7:
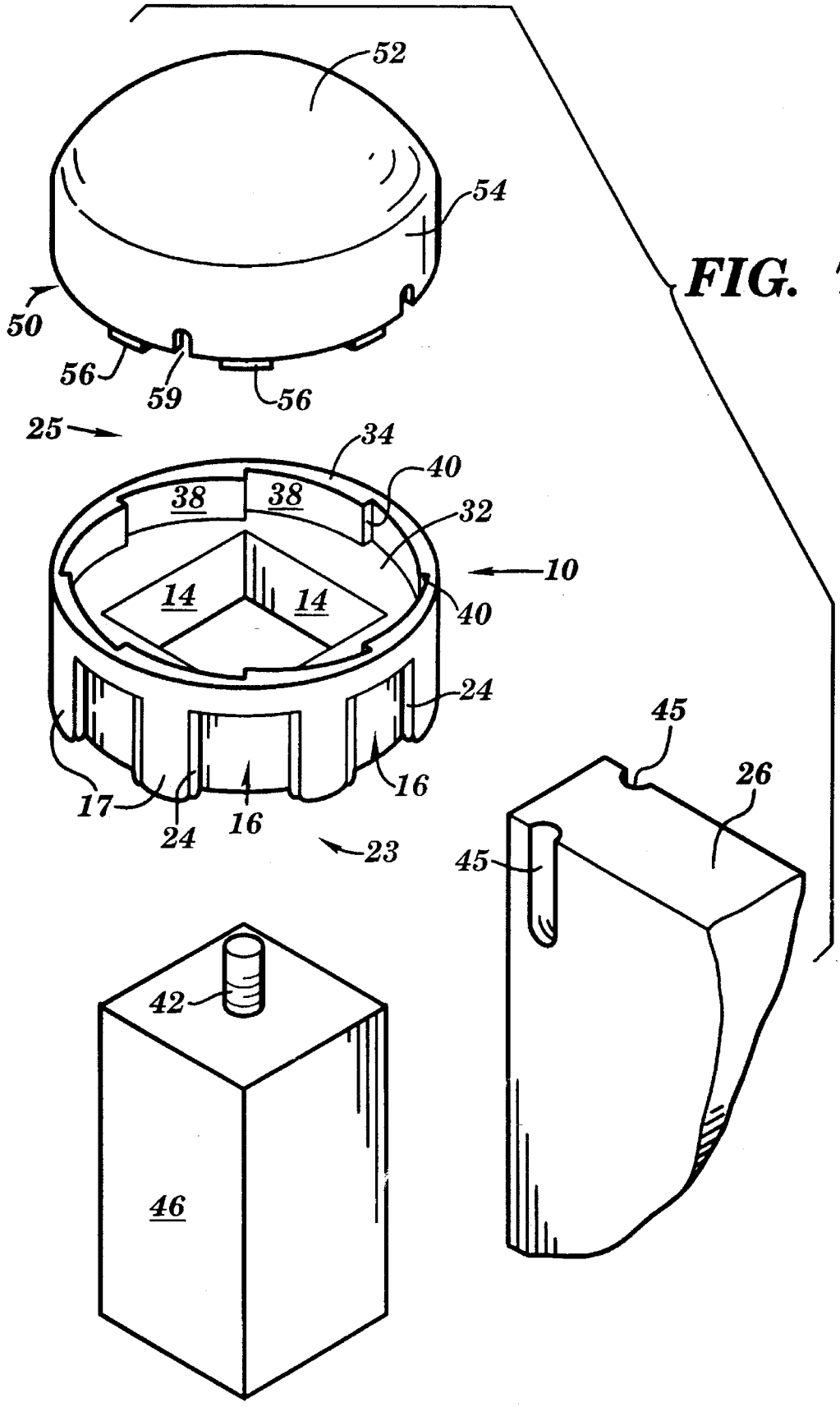
FIG. 7 is an exploded perspective view of a hub and cap of a loft connector joint of the present invention.

FIG. 5 depicts a child's loft assembly 70 employing a plurality of loft connector joints of the present invention. While FIG. 5 shows an overall view of child's loft assembly 70, a portion of the spindles of the loft have been cut-away for purposes of clarity. It should be understood that various orientation of hubs 10 and/or caps 50 may be employed in constructing child's loft assembly 70. For instance, every hub 10 employed in child's loft assembly 70 does not have a corresponding cap 50, and numerous hubs 10 alone are employed as loft connector joints of the present invention. Typically, caps 50 will be employed with hubs 10 to top off those hubs which are situated on the upper end of posts 46. When hub 10 is positioned at the top of post 46, first end 23 faces upward so that a corresponding cap 50 may be attached thereto.

Many other hubs 10, however, may be employed without caps. For instance, hubs 10 may be positioned on the lower end of a post, or in the middle of a post. If a hub is positioned at the bottom of the post, typically the first end is oriented upward. By orienting the first end upward, variously sized and shaped panels may be received by sockets 16 in an upward orientation.

In another aspect of the present invention, a plurality of hubs 10 may be oriented contiguous to each other. For example, a dual hub 71 may be employed in construction of loft 70. Preferably, second ends 25 of each individual hub 10 are aligned together to form dual hub 71. The alignment of second ends 15 results in one hub 10 having its first end oriented upward, and the other hub 10 having its first end oriented downward.

The loft connector joints of the present invention, as described hereinabove, have been designed for simple and easy loft assembly and construction. Typically, installation of a loft structure like 70, starts by standing a first post 46 vertically on the floor of a classroom. Next, a first hub 10 may be slid vertically on first post 46 so that its sockets 16 face upward (first end 23 facing up). The bottom of each post 46 may include a foot (not shown) or other structure for preventing hub 10 from sliding off of post 46. This foot may be threadably attached to post 46 and may also include a material having a high coefficient of friction, e.g., rubber, to prevent any movement of post 46 along the classroom floor. Therefore, hub 10 rests on the foot (not shown). Thereafter, an edge of a first panel 26 may be slidably inserted into one of the sockets of the first hub 10. Once first panel 26 is engaged by first hub 10, a second hub 10 may be slid vertically onto first post 46 so that its sockets 16 face down (first end 23 facing down). One of the sockets 16 of the second hub 10 may then be engaged by an edge of first panel 26. This process may continue, and caps 50 may be attached to hubs 10 which are located on the top of posts 46. Ultimately, after the process continues, the desired loft structure will be complete. The present invention also facilitates easy and simple modification and relocation of an existing loft structure.

By permitting tool free loft assembly and construction, the present invention is designed for easy loft assembly by someone with limited time and loft construction skills, like many teachers. Furthermore, the hub/cap arrangement provides a child's loft 70 having limited exposed hardware, thereby facilitating a safe classroom environment. Finally, peripheral arrangement of sockets 16 permits easy assembly of numerous different loft configurations.

While both panel 26 and post 46 are preferably wooden, other suitable materials may be used in lieu thereof. For instance, panel 26 and post 46 may be made from various metals and plastics. Similarly, while both hub 10 and cap 50 are preferably of molded polycarbonate, other materials may be substituted therefor. However, for purposes of durability and strength, molded polycarbonate is preferred.

The term loft, as described in this specification, is meant to refer to any support structure which employs posts and panels in its construction. Therefore, it is understood that the loft connector joints of the present invention are not limited to the construction and assembly of children's lofts. Instead, it is intended that the loft joint connectors of the present invention be employed in any support structure.

While several aspects of the present invention have been described and depicted herein, alternative aspects may be effected by those skilled in the art to accomplish the same objectives. For instance, while the preferred embodiment employs an hexagonal core, other shaped cores are suitable. For instance, the core may be rectangular in shape or square in shape. Furthermore, while eight sockets are preferred for the hub, it is understood that a hub having a different number of sockets may be desirable. Moreover, while the outer periphery of both the hub and cap of the present invention is circular in cross-section, other suitable shapes may be suitable. Accordingly, it is intended by the appended claims to cover all such alternative aspects as fall within the true spirit and scope of the invention.

We claim:

1. A loft connector joint, comprising:

a hub having a first end, a second end, an outer periphery, and an axial core oriented along a longitudinal axis extending from said first end to said second end;

said axial core being hollow and configured for slidable engagement with a post of a loft; and a plurality of sockets positioned about said outer periphery and facing outward from the center of said hub, each of said plurality of sockets configured for slidably receiving and retaining an edge of a panel of the loft, said sockets extending from said first end toward said second end and further having an opening at said first end and further having a floor integral to said hub proximate said second end.

2. The connector of claim 1, further comprising a removable cap securable to said second end of said hub.

3. The connector of claim 2, wherein said cap further comprises a threaded insert for threadably engaging said cap to a threaded bolt protruding from one end of a post, said insert encapsulated in a core member centrally located on the underside of said cap.

4. The connector of claim 3, wherein said cap further comprises one or more support arms attached to the underside of said cap, said one or more support arms extending from said core member radially outward to said outer wall.

5. The connector of claim 2, wherein said cap comprises polycarbonate.

6. The connector of claim 1, wherein each of said plurality of sockets are defined by two opposing side walls, and a back wall, all of which are oriented substantially along said longitudinal axis.

7. The connector of claim 6, wherein each of said plurality of sockets is further defined by a floor, which is substantially orthogonal to said side and back walls.

8. The connector of claim 6, wherein each of said side walls further comprises a rib section abutting therefrom to allow an edge of a panel to be slidably engaged within said socket and be retained therein.

9. The connector of claim 1, wherein said second end of said hub comprises a lip extending from a ledge.

10. The connector of claim 1, wherein said axial core is shaped to correspond to the cross-sectional shape of a post.

11. The connector of claim 10, wherein the axial core has a square-shape, having four core walls oriented substantially along said longitudinal axis of said hub.

12. The connector of claim 10, wherein said axial core has an octagonal-shape, having eight core walls oriented substantially along said longitudinal axis of said hub.

13. The connector of claim 12, wherein said axial core has a octagonally shaped post inserted therein.

14. The connector of claim 13, wherein said post is wooden.

15. The connector of claim 1, wherein said panel has an edge having a groove sized therein for slidable insertion into said rib section of said socket.

16. The connector of claim 15, wherein said panel includes a plurality of grooves for slidable insertion into a plurality of rib sections of said socket.

17. The connector of claim 1, wherein said connector comprises polycarbonate.

18. A loft connector joint comprising:

a hub having a first end, a second end, an outer periphery, and an axial core oriented along a longitudinal axis extending from said first end to said second end;

said axial core being hollow and configured for slidable engagement with a post of a loft; and a plurality of sockets positioned about said outer periphery and facing outward from the center of said hub, each of said plurality of sockets configured for slidably receiving and retaining an edge of a panel of the loft, and said second end of said hub comprises a lip extending from a ledge wherein said lip comprises a plurality of ramps, each of said ramps having a first face and a second face.

19. The connector of claim 18, wherein said first face is arcuate.

20. The connector of claim 19, wherein the thickness of each of said plurality of ramps increases from a first point on said first face to a second point on said first face.

21. The connector of claim 18, wherein said second face is planar.

22. The connector of claim 21, wherein the thickness of each of said plurality of ramps increases from a first point on said second face to a second point on said second face.

23. The connector of claim 22, wherein the second point forms a thickest portion of each of said first and second faces.

24. The connector of claim 22, further comprising a removable cap secured to said second end of said hub.

25. The connector of claim 24, wherein said cap comprises:

a bowl-shaped member having a domed top and an outer wall;

a plurality of tabs extending from an underside of said bowl-shaped member, said plurality of tabs being deflectable.

26. The connector of claim 25, wherein said plurality of tabs are deflectable radially inward towards the center of said cap.

27. The connector of claim 26, wherein each of said plurality of tabs includes an angled edge, said edge configured to be mutually adapted with said second face of said each of said plurality of ramps when said cap and hub are attached.

28. The connector of claim 27, wherein each of said plurality of tabs has a bottom, said bottom having a variable thickness increasing from a first location to said angled edge.

29. The connector of claim 28, further comprising means for permitting clockwise rotation of said cap in relation to said hub at a particular torque and said means permitting counter-clockwise rotation of said cap in relation to said hub at a torque greater than said particular torque.

30. The connector of claim 28, wherein said means for permitting rotation comprises:

said cap is axially alignable with said hub connector to allow said outer wall of said cap to be joined to said lip of said hub and said plurality of tabs to be oriented about said ledge and adjacent said plurality of ramps; and wherein clockwise rotation of said cap in relation to said connector allows each of said plurality of tabs to contact with a corresponding first face of one of said plurality of ramps, and wherein further clockwise rotation of said cap deflects said tabs inward to a position where said plurality of tabs advance past said corresponding plurality of first faces and said cap is restrained from being rotated in a counterclockwise direction.

31. The connector of claim 25, wherein:

said cap is axially alignable with said hub connector to allow said outer wall of said cap to be joined to said lip of said hub and said plurality of tabs to be oriented about said ledge and adjacent said plurality of ramps; and wherein clockwise rotation of said cap in relation to said connector allows each of said plurality of tabs to contact with a corresponding first face of one of said plurality of ramps, and wherein further clockwise rotation of said cap deflects said tabs inward to a position where said plurality of tabs advance past said corresponding plurality of first faces and said cap is restrained from being rotated in a counterclockwise direction.

32. The connector of claim 25, wherein said outer wall is mutually adapted to be aligned and mated with said lip of said second end of said hub.

33. The connector of claim 32, wherein said lip and said outer wall are correspondingly circular.

34. The connector of claim 25, wherein said outer wall includes one or more openings for insertion of a tool therein.

35. A loft connector joint, comprising:

a hub having a first end, a second end, an outer periphery, and an axial core oriented along a longitudinal axis extending from said first end to said second end, said axial core being hollow and configured for slidable engagement with a post of loft framework;

a plurality of fins positioned about said outer periphery, each of said plurality of fins extending from said first end towards said second end, a floor integral to said hub positioned between said fins proximate said second end, wherein said plurality of fins adjacent to one another and said floor define a socket for slidably receiving and retaining an edge of a panel of the loft framework.

36. The connector of claim 35, wherein each of said plurality of fins includes a rib abutting therefrom for retaining an edge of a panel in said recess.

37. A loft assembly, comprising:

a plurality of loft connector joints, each of said plurality of connectors comprising:

a hub having a first end, a second end, an outer periphery, and an axial core oriented along a longitudinal axis extending from said first end to said second end;

a plurality of sockets positioned about said outer periphery, each of said plurality of sockets configured for slidably receiving and retaining an edge of a panel of a loft assembly, said sockets extending from said first end toward said second end and further having an opening at said first end and a floor integral to said hub proximate said second end;

said axial core being hollow and configured for slidable engagement with a post of the loft assembly;

a plurality of panels engaged with said plurality of sockets wherein said panel fixes said hub at a position along the length of said posts; and a plurality of caps removably attached to at least some of said connectors.

38. The child's loft assembly of claim 37, wherein each of said plurality of caps comprises means for restraining said cap from counter-clockwise rotation when said cap and said connector are coupled.

39. The child's loft assembly of claim 38, wherein said each of said plurality of connectors comprises means for restraining said cap from counter-clockwise rotation when said cap and said connector are coupled.

40. The child's loft assembly of claim 37, wherein said plurality of posts are octagonal in cross-section.

41. The child's loft assembly of claim 40, wherein said plurality of posts and said plurality of panels are wooden.

* * * * *